US012503919B2

(12) United States Patent
Li et al.

(10) Patent No.: US 12,503,919 B2
(45) Date of Patent: Dec. 23, 2025

(54) INTEGRATED PLUGGING AND PERFORATING OPERATION SYSTEM

(71) Applicant: BAOJI SAFE PETROLEUM MACHINERY CO., LTD., Shaanxi (CN)

(72) Inventors: Jianbo Li, Shaanxi (CN); Ziqiang Kang, Shaanxi (CN); Jianfeng Yao, Shaanxi (CN); Xijun Jiang, Shaanxi (CN); Dawei Zhang, Shaanxi (CN); Liang Bai, Shaanxi (CN); Teng Li, Shaanxi (CN); Haiquan Li, Shaanxi (CN); Enfeng Yang, Shaanxi (CN); Yaliang Hu, Shaanxi (CN); Lin Qi, Shaanxi (CN); Yonggang Lv, Shaanxi (CN); Zhen Yuan, Shaanxi (CN); Qiujuan Zhang, Shaanxi (CN); Rui Mao, Shaanxi (CN); Bingwen Wei, Shaanxi (CN)

(73) Assignee: BAOJI SAFE PETROLEUM MACHINERY CO., LTD., Baoji (CN)

( * ) Notice: Subject to any disclaimer, the term of this patent is extended or adjusted under 35 U.S.C. 154(b) by 0 days.

(21) Appl. No.: 18/640,876

(22) Filed: Apr. 19, 2024

(65) Prior Publication Data

US 2025/0052126 A1 Feb. 13, 2025

(30) Foreign Application Priority Data

Aug. 7, 2023 (CN) ..... 202310988893.4

(51) Int. Cl.

| | |
|---|---|
| ***E21B 15/00*** | (2006.01) |
| ***E21B 19/22*** | (2006.01) |
| ***E21B 33/068*** | (2006.01) |

(52) U.S. Cl.

CPC ..... *E21B 15/00* (2013.01); *E21B 19/22* (2013.01); *E21B 33/068* (2013.01)

(58) Field of Classification Search

CPC ..... E21B 15/00; E21B 33/068; E21B 33/06; E21B 19/22; E21B 23/00; F16H 7/18

See application file for complete search history.

(56) References Cited

U.S. PATENT DOCUMENTS 1,973,446 A * 9/1934 Resenquist ..... B66D 1/38 242/483

3,539,053 A * 11/1970 Lado ..... F16D 55/228 192/225

(Continued)

FOREIGN PATENT DOCUMENTS

WO WO-2015086656 A2 * 6/2015 ..... E21B 15/00

*Primary Examiner* — George S Gray

(74) *Attorney, Agent, or Firm* — Procopio, Cory, Hargreaves & Savitch LLP

(57) ABSTRACT

An integrated plugging and perforating operation system includes an operation truck, a wellhead equipment transport frame a centralized control room and wellhead blowout preventers. A mechanical mechanism and a power mechanism are arranged on a chassis of the operation truck. The mechanical mechanism includes a turntable assembly, where a telescopic arm assembly is installed on the turntable assembly, a mechanical arm assembly for logging operation is installed at an operating end of the telescopic arm assembly, and a logging winch assembly and a follow-up winch assembly are arranged at a counterweight end of the telescopic arm assembly to form a counter weight of the telescopic arm assembly. The power mechanism is configured for providing power output to the mechanical mechanism.

7 Claims, 9 Drawing Sheets

(56) References Cited

U.S. PATENT DOCUMENTS

| | | | | |
|---|---|---|---|---|
| 4,204,664 | A * | 5/1980 | Bryan, Jr. | B66D 1/741 254/311 |
| 5,645,181 | A * | 7/1997 | Ichiba | B66C 13/46 212/281 |
| 6,003,598 | A * | 12/1999 | Andreychuk | E21B 19/22 166/77.2 |
| 7,878,346 | B1 * | 2/2011 | Watts | B66C 23/702 212/300 |
| 2009/0260804 | A1 * | 10/2009 | Mydur | E21B 7/02 166/250.01 |
| 2015/0068726 | A1 * | 3/2015 | Vogt | E21B 19/00 166/76.1 |
| 2016/0289054 | A1 * | 10/2016 | Hiekata | B66D 5/30 |
| 2018/0238467 | A1 * | 8/2018 | Sundar | G01M 3/02 |
| 2019/0177137 | A1 * | 6/2019 | De Matos | B66D 1/12 |
| 2024/0426196 | A1 * | 12/2024 | Dumanli | E21B 47/024 |

* cited by examiner

INTEGRATED PLUGGING AND PERFORATING OPERATION SYSTEM

CROSS-REFERENCE TO RELATED APPLICATION

This patent application claims the benefit and priority of Chinese Patent Application No. 202310988893.4, entitled "INTEGRATED PLUGGING AND PERFORATING OPERATION SYSTEM" filed on Aug. 7, 2023, the disclosure of which is incorporated by reference herein in its entirety as part of the present application.

TECHNICAL FIELD

The present disclosure relates to the technical field of petroleum devices, and in particular to an integrated plugging and perforating operation system.

BACKGROUND

In the conventional cable plugging and perforating integrated operation, the ground equipment used includes a logging truck, a truck crane and a cable blowout preventer. The logging truck and the truck crane are self-contained and each needs a driver and operator. Besides main pressure-bearing parts, the cable blowout preventer is also equipped with a hydraulic control grease injection system, a diesel air compressor, a plugging connector control system, and a hydraulic-controlled flow-dividing system.

In the field application, the whole process from the self-connection and disassembly of the blowout preventer to the construction operation is inseparable from the lifting of the truck crane, and the lease method is used by the plugging and perforating team usually to meet the needs of the field construction operation. As the existing truck cranes, logging trucks and blowout preventers in the well site are low in automation and integration, and have many inefficient construction links, both the workload and labor intensity on the construction site are large, and thus there are more people needed for the operation team. Personnel disassembly operation is close to the wellhead, leading to high safety risk during operation, and the personnel cost, the management cost and the operation cost are high.

SUMMARY

For the problem above, the embodiments aim is to provide an integrated plugging and perforating operation system, which can combine various operation equipment into a whole, so as to reduce operation flow and form a new operation system.

To achieve the objective above, the technical solution adopted by the present disclosure is as follows.

An integrated plugging and perforating operation system includes an operation truck, a wellhead equipment transport frame, a centralized control room and wellhead blowout preventers. A mechanical mechanism and a power mechanism are arranged on a chassis of the operation truck.

The mechanical mechanism includes a turntable assembly. A telescopic arm assembly is installed on the turntable assembly. A mechanical arm assembly configured for logging operation is installed at an operating end of the telescopic arm assembly, and a logging winch assembly and a follow-up winch assembly are arranged at a counterweight end of the telescopic arm assembly. The logging winch assembly and the follow-up winch assembly form a counter weight of the telescopic arm assembly.

The power mechanism is configured for providing power output for the mechanical mechanism.

The centralized control room communicates with the operation truck through a cable, and is configured to control the chassis and each of the turntable assembly, the logging winch assembly, the follow-up winch assembly, the telescopic arm assembly and the mechanical arm assembly in the mechanical mechanism.

The wellhead equipment transport frame is configured for carrying wellhead blowout preventers to facilitate transportation.

The turntable assembly may include a slewing support on the chassis of the operation truck. A slewing motor configured for driving the slewing support to rotate and a rotating joint may be installed on the slewing support. The telescopic arm assembly may be installed at a middle of the slewing support.

The telescopic arm assembly may include a telescopic arm and a lift hydraulic cylinder installed on the turntable assembly. A telescopic oil cylinder may be installed on the telescopic arm. A connecting bearing may be installed at the operating end of the telescopic arm. The mechanical arm assembly may be installed on the connecting bearing.

The mechanical arm assembly may include an upper manipulator, and a lower manipulator may be hinged to the upper manipulator. A first gripper may be installed on the upper manipulator, a second gripper may be installed on the lower manipulator. A sealing device may be clamped by the upper manipulator, and a lubricator may be clamped by the lower manipulator.

The logging winch assembly may include a drum frame installed on the turntable assembly, and a winch drum, an automatic rope-arranging device and a metering device may be installed on the drum frame.

A built-in planetary reducer and a first hydraulic motor may be installed on a rotating shaft of the winch drum, and a brake device may be installed on a side of the winch drum.

The follow-up winch assembly may include multiple drums which are arranged coaxially and are installed on the turntable assembly, and a second hydraulic motor may be arranged on each of the multiple drums.

A console may be arranged in the centralized control room. A wellhead blowout preventer control module, a logging winch control module, a telescopic arm control module, a mechanical arm control module and a perforator control module may be arranged on the console.

The chassis of the operation truck may be provided with hydraulic legs and a telescopic arm support configured for supporting only the telescopic arm.

Compared with the prior art, the embodiments have beneficial effects as follows.

An integrated plugging and perforating operation system is provided, a logging truck, a truck crane and a wellhead blowout preventer applied in the existing plugging and perforating operation are deeply integrated into a whole and share power. Not only the purchase cost and the use cost of the equipment are reduced, but also the centralized control room is placed in a safe area far away from a wellhead, and the truck crane, the logging winch and the wellhead blowout preventer are remotely controlled to carry out construction operation. The equipment has a high level of automation, digitalization and intelligence, and has the functions of wellhead identification and automatic positioning, digital wireless transmission of signals, full record of the operation process, automatic alarm of abnormal conditions and so on.

Figure 1:
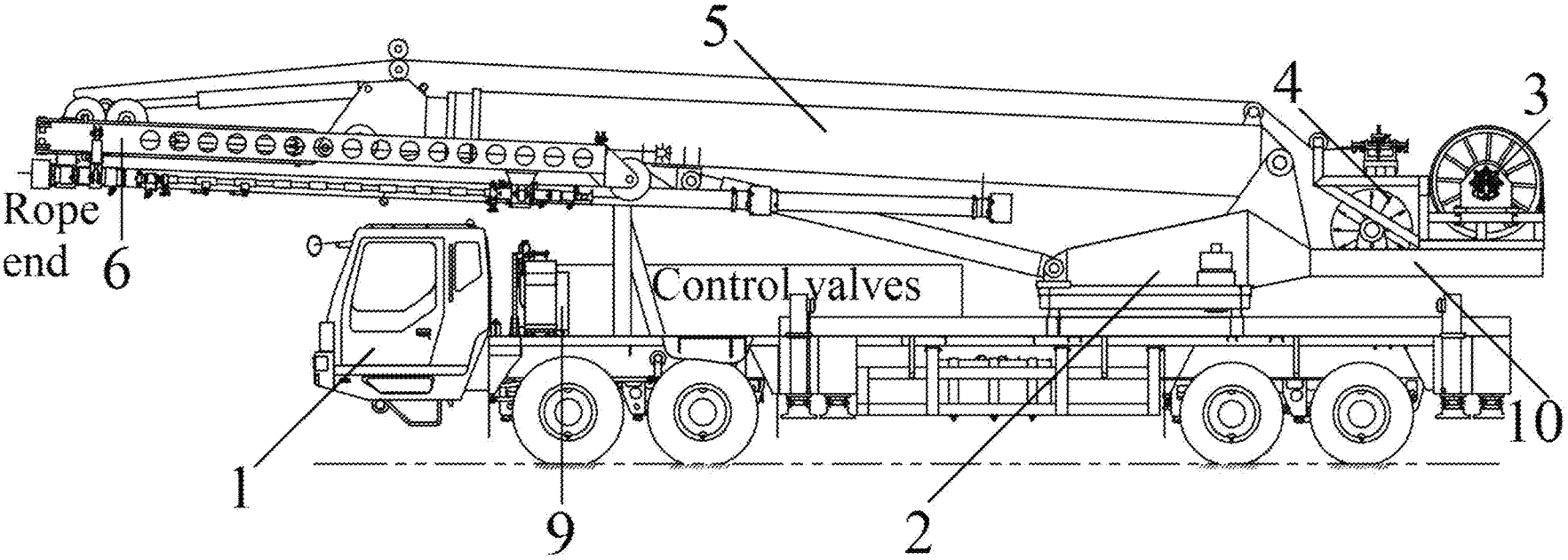
FIG. 1 is a structural schematic diagram of an operation truck according to the present disclosure.

List of the reference characters: 1 operation truck; 11 hydraulic leg; 12 telescopic arm support; 2 turntable assembly; 21 slewing support; 22 slewing motor; 23 rotating joint; 3 logging winch assembly; 31 winch drum; 32 drum frame; 33 brake device; 34 automatic rope arranging device; 35 metering device; 36 planetary reducer; 37 first hydraulic motor; 4 follow up winch assembly; 41 second hydraulic motor; 42 drum; 5 telescopic arm assembly 51 telescopic arm; 52 telescopic hydraulic cylinder; 53 connecting bearing; 54 lift oil cylinder; 6 mechanical arm assembly; 61 upper manipulator; 62 lower manipulator; 63 sealing device; 64 lubricator; 65 first gripper; 66 second gripper; 7 centralized control room; 71 console; 72 logging winch control module; 73 telescopic arm control module; 74 blowout preventer control module; 75 mechanical arm control module; 76 perforator control module; 8 wellhead equipment transport frame; 81 wellhead blowout preventer; 9 power mechanism; 10 counter weight.

DETAILED DESCRIPTION OF THE EMBODIMENTS

The following describes the present disclosure in detail with reference to the drawings. Apparently, the described embodiments are merely a part rather than all of the embodiments of the present disclosure. All other embodiments obtained by a person of ordinary skill in the art based on the embodiments of the present disclosure without creative efforts shall fall within the scope of protection of the present disclosure.

Figure 2:
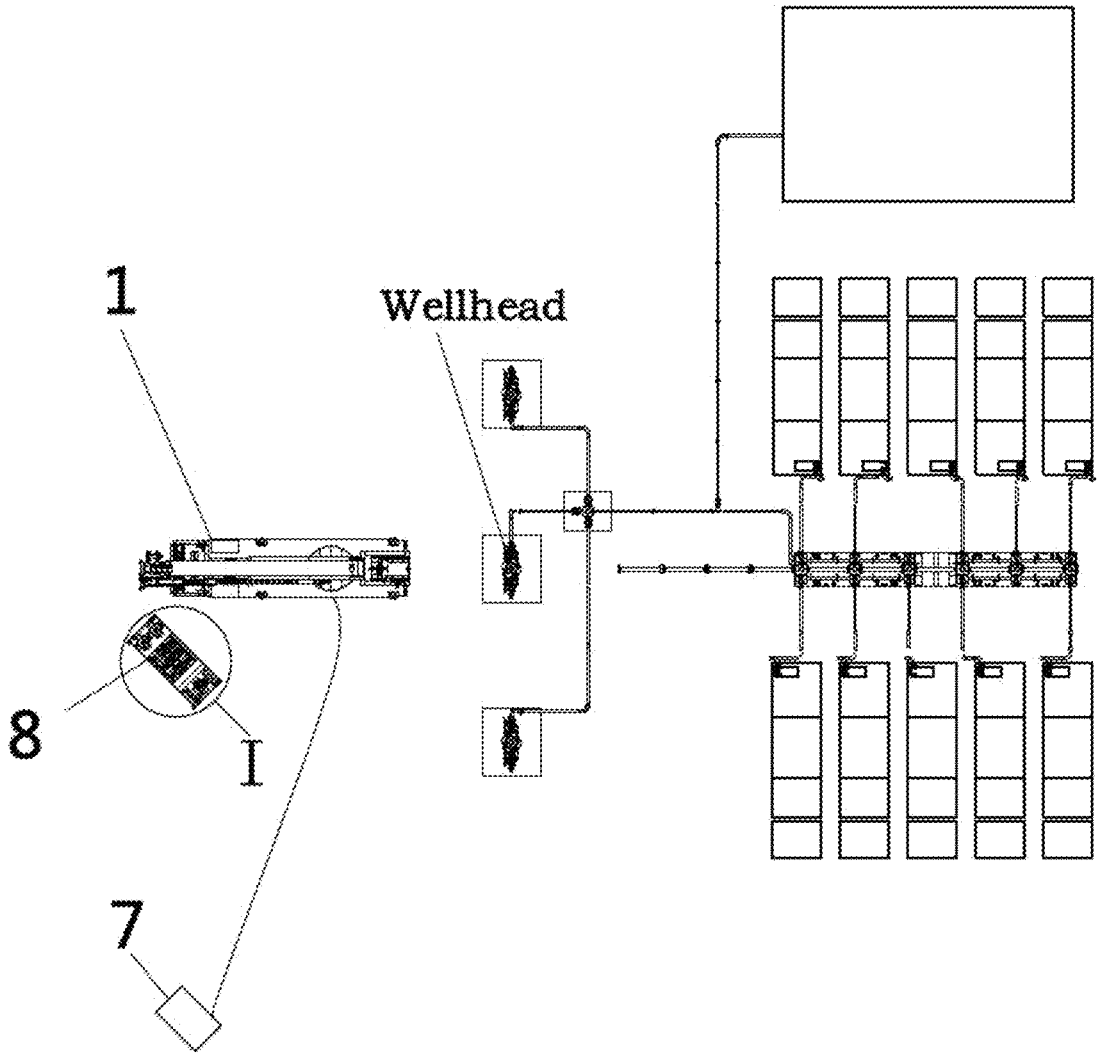
FIG. 2 is a layout diagram of a well site according to the present disclosure.

As shown in FIG. 1 and FIG. 2, an integrated plugging and perforating operation system disclosed by the present disclosure includes an operation truck 1, a wellhead equipment transport frame 8 a centralized control room 7, and wellhead blowout preventers 81. A mechanical mechanism and a power mechanism 9 are arranged on a chassis of the operation truck 1.

The mechanical mechanism includes a turntable assembly 2, a telescopic arm assembly 5 is installed on the turntable assembly 2. A mechanical arm assembly 6 configured for logging operation is installed at an operating end of the telescopic arm assembly 5. A logging winch assembly 3 and a follow-up winch assembly 4 are arranged at a counterweight end of the telescopic arm assembly 5. The logging winch assembly 3 and the follow-up winch assembly 4 form a counter weight 10 of the telescopic arm assembly 5.

The power mechanism 9 is configured for providing power output for the mechanical mechanism.

The centralized control room 7 communicates with the operation truck 1 by a cable, and is configured to control the chassis and each assembly in the mechanical mechanism to complete the operation.

The wellhead equipment transport frame 8 is configured for carrying each wellhead blowout preventer 81 to facilitate transportation.

Figure 3:
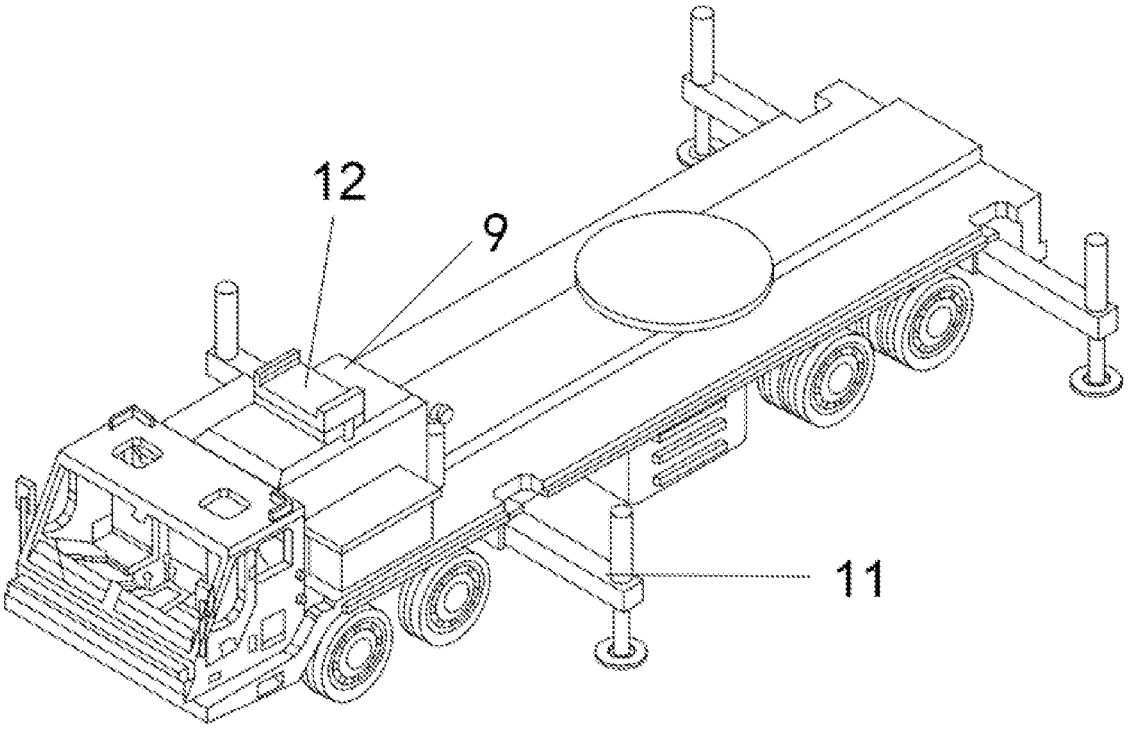
FIG. 3 is a structural diagram of a chassis of an operation truck according to the present disclosure.

It should be noted that, as shown in FIG. 3, in the present disclosure, the operation truck 1 includes a chassis and a cab arranged on the chassis. The chassis of the truck serves as a bearing body of the whole machine, provides power for the system, and is configured for installing components such as a turntable assembly, control valves, a diesel generator and a hydraulic leg. For example, the chassis of the operation truck 1 is provided with hydraulic legs 11, and a telescopic arm support 12 configured for supporting only the telescopic arm. When the operation truck 1 is parked at a fixed position, the truck body may be fixed to the ground by opening the hydraulic legs 11, so as to achieve the purpose of stabilizing the truck body during operation.

Figure 4:
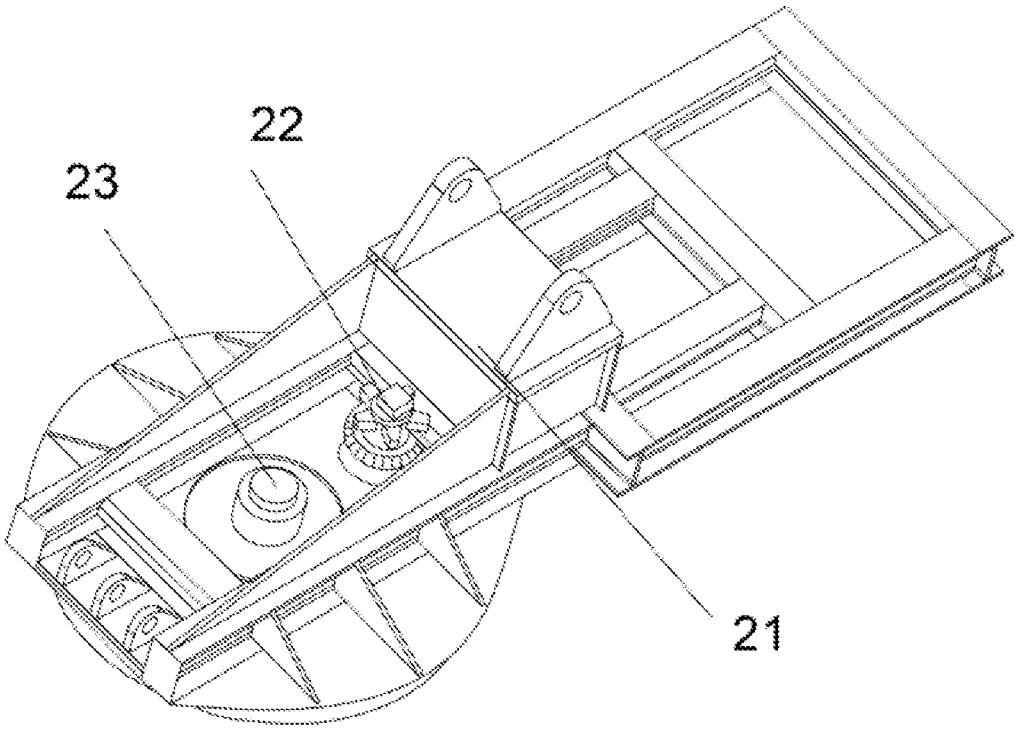
FIG. 4 is a structural diagram of a turntable assembly according to the present disclosure.

As shown in FIG. 4, in the present disclosure, the turntable assembly 2 includes a slewing support 21 installed on the chassis of the operation truck 1. A slewing motor 22 configured for driving the slewing support 21 to rotate and a rotating joint 23 are installed on the slewing support 21, and the telescopic arm assembly 5 is installed at a middle of the slewing support 21. The turntable assembly 2, as a slewing center of the telescopic arm, may rotate by 360°, and includes the slewing support, the slewing motor, the rotating joint, the counter weight 10, a connecting bearing, and the other components.

Figure 5:
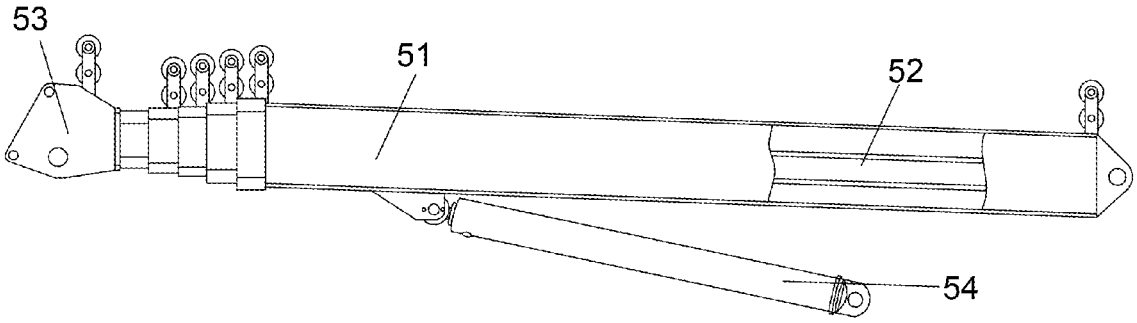
FIG. 5 is a structural diagram of a telescopic arm assembly according to the present disclosure.

As shown in FIG. 5, the telescopic arm assembly 5 includes a telescopic arm 51 and a lift hydraulic cylinder 54 installed on the turntable assembly 2. A telescopic oil cylinder 52 is installed on the telescopic arm 51, a connecting bearing 53 is installed at the operating end of the telescopic arm 51, and the mechanical arm assembly 6 is rotatably installed on the connecting bearing 53. When telescopic arm 51 extends out, the mechanical arm assembly 6 rotates to be perpendicular to the ground, and is configured for lifting operations when the wellhead blowout preventer 81 is disassembled and assembled, and gripping a lubricator string during logging and perforating operations. A lubricator string assembly is mainly configured for sealing a wellhead during logging and perforating operations, and mainly includes a sealing device 63, an upper catcher, a shearing device, a lubricator and the like.

Figure 6:
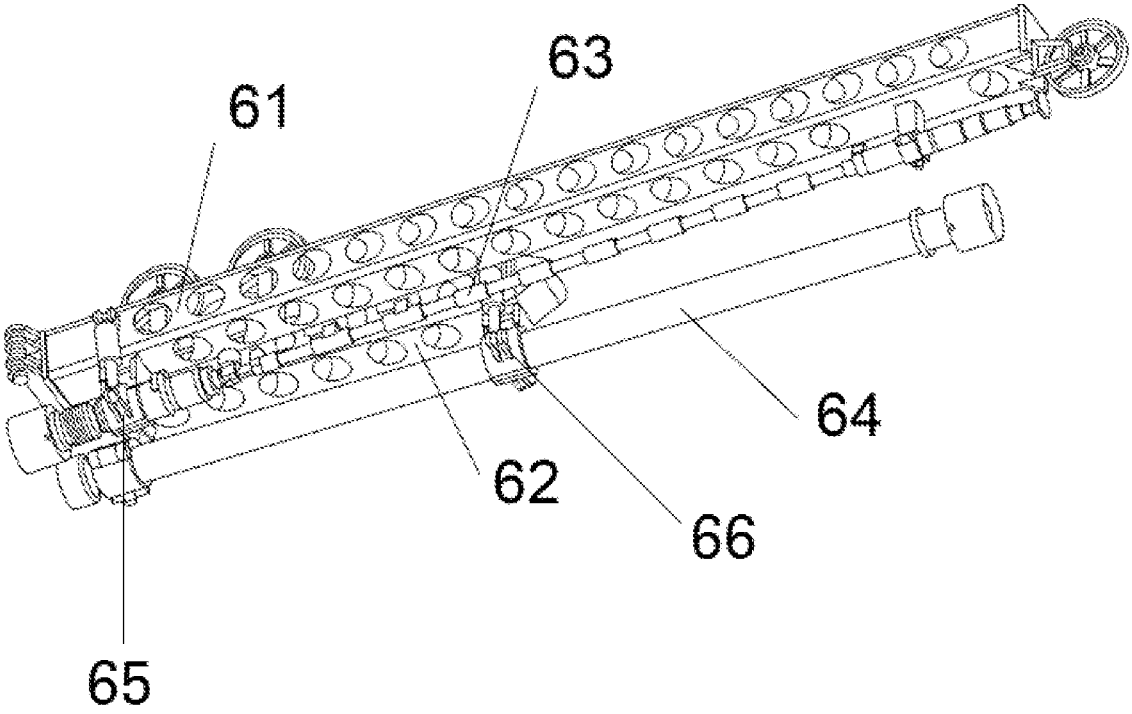
FIG. 6 is a structural diagram of a mechanical arm assembly according to the present disclosure.

As shown in FIG. 6, the mechanical arm assembly 6 includes an upper manipulator 61, a lower manipulator 62 is hinged to the upper manipulator 61, and a first gripper 65 is installed on each of the upper manipulator 61, and a second gripper 66 is installed on the lower manipulator 62. A sealing device 63 is clamped by the upper manipulator 61, and a lubricator 64 is clamped by the lower manipulator 62. The mechanical arm assembly is further provided with an adjusting hydraulic cylinder, a fixed support, a guide pulley, a support pulley and other components for adjusting a direction of a cable.

Figure 7:
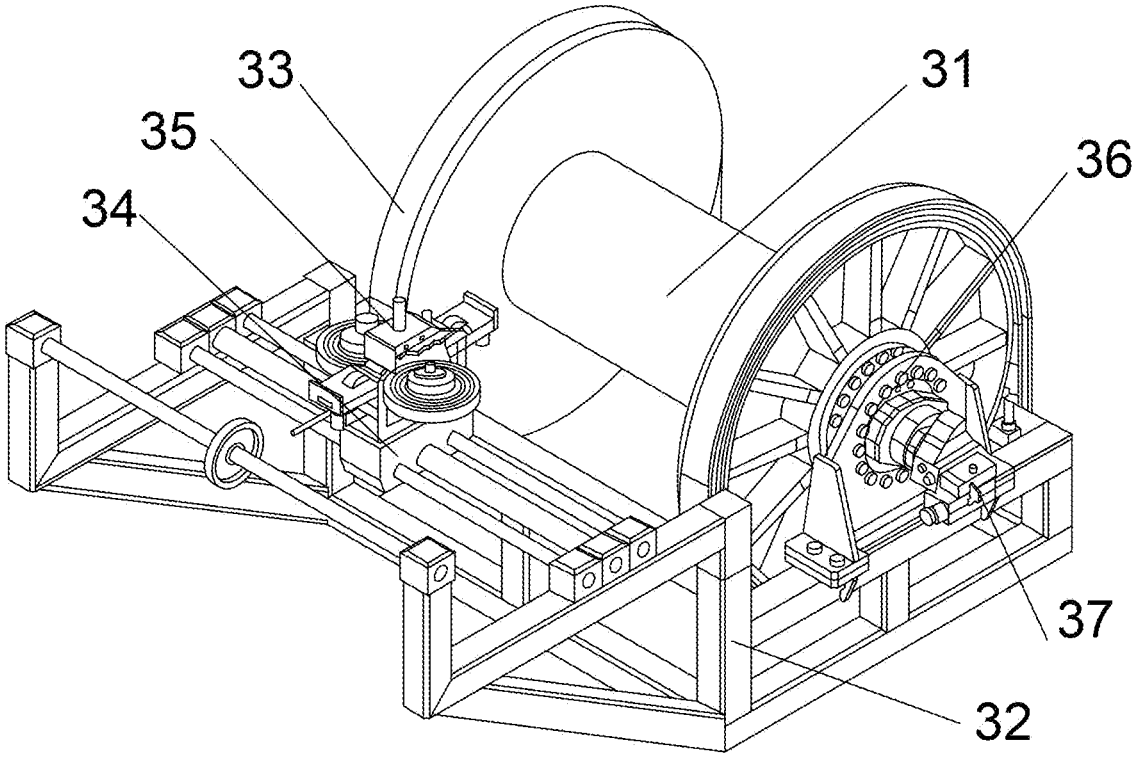
FIG. 7 is a structural diagram of a logging winch assembly according to the present disclosure.

As shown in FIG. 7, the logging winch assembly 3 includes a winch drum 31, a drum frame 32, a brake device 33, an automatic rope-arranging device 34, a metering device 35, a built-in planetary reducer 36, and a first hydraulic motor 37. Specifically, the drum frame 32 is installed on the turntable assembly 2, the winch drum 31, the automatic rope-arranging device 34 and the metering device 35 are installed on the drum frame 32. The built-in planetary reducer 36 and the first hydraulic motor 37 are installed on a rotating shaft of the winch drum 37, and the brake device 33 is installed on a side of the winch drum 31. The winch drum 31 is configured for winding the cable for logging and perforating. By controlling the lifting and lowering of the winch drum, various instruments and tools are transported to the downhole, and power supply and control signals are provided to the downhole instruments and tools, and the signals collected by the downhole instruments are transmitted to the ground.

Figure 8:
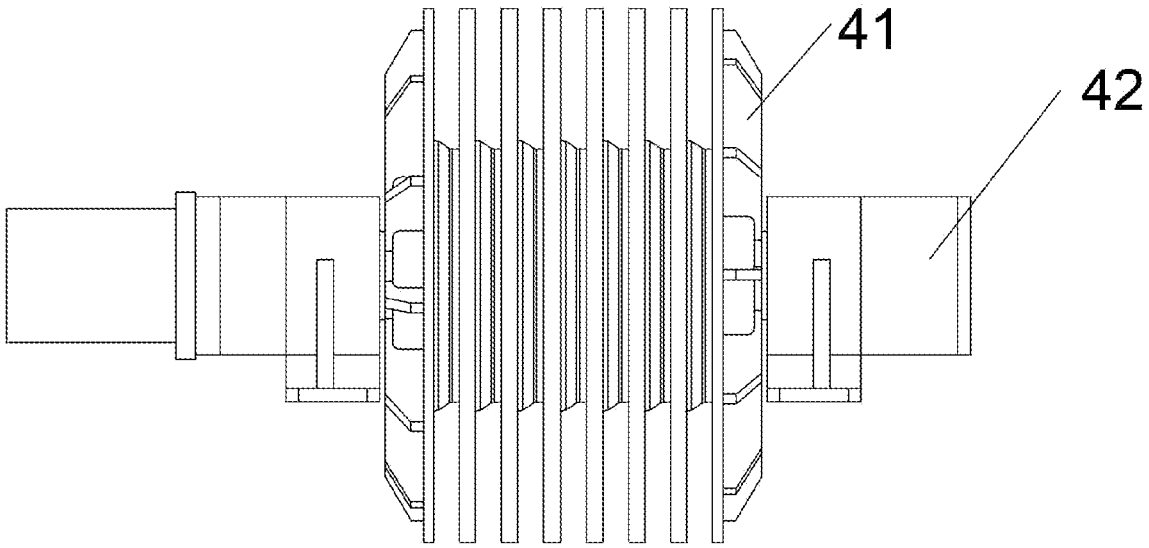
FIG. 8 is a structural diagram of a follow-up winch assembly according to the present disclosure.

As shown in FIG. 8, the follow-up winch 4 assembly includes multiple drums 42 which are arranged coaxially and are installed on the turntable assembly 2, and a second hydraulic motor 41 is arranged on the multiple drums 42 configured for winding a control line for controlling the mechanical arm, and automatically releasing and retracting the control line according to the extension and retraction of the telescopic arm.

Figure 9:
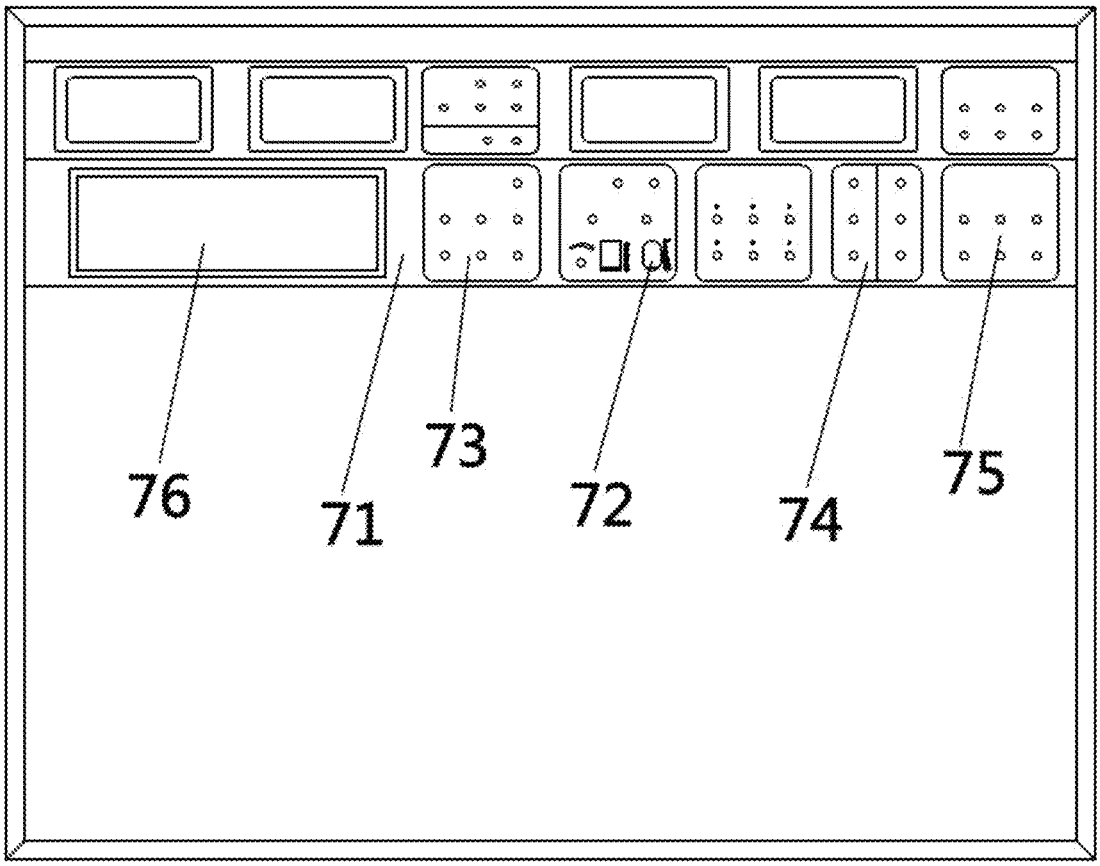
FIG. 9 is a structural diagram of a centralized control room according to the present disclosure.

As shown in FIG. 9, the centralized control room 7 communicates with the operation truck 1 by a cable, a console 71 is arranged in the centralized control room 7, and a wellhead blowout preventer control module 74, a logging winch control module 72, a telescopic arm control module 73, a mechanical arm control module 75 and a perforator control module 76 are arranged on the console 71 for controlling a wellhead blowout preventer, the logging winch, the telescopic arm, the mechanical arm, and the perforator. Moreover, an air conditioner, heating equipment, a lighting lamp, an operation chair and other components are provided in the centralized control room 71.

The operation process of the present disclosure is as follows.

(1) Advance Preparation

According to the construction requirements, the operation truck 1 is moved to a pre-designed position, and is fixed after the orientation is adjusted.

The centralized control room 7 is connected with the power system and a wellhead control system through a cable.

(2) Installation and Positioning of Lubricator String Assembly

Figure 10:
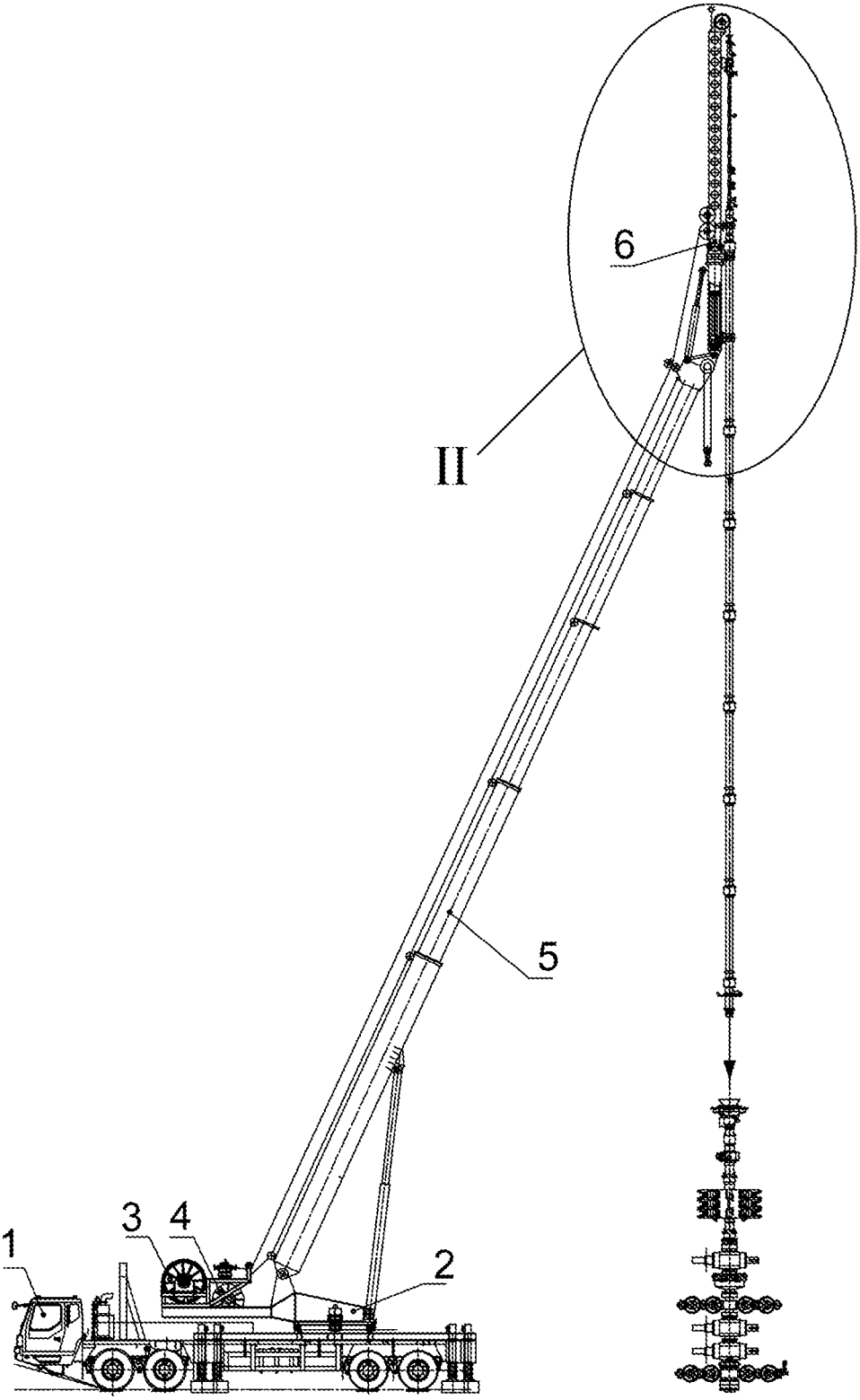
FIG. 10 is a schematic diagram of an operation process according to the present disclosure.
Figure 11:
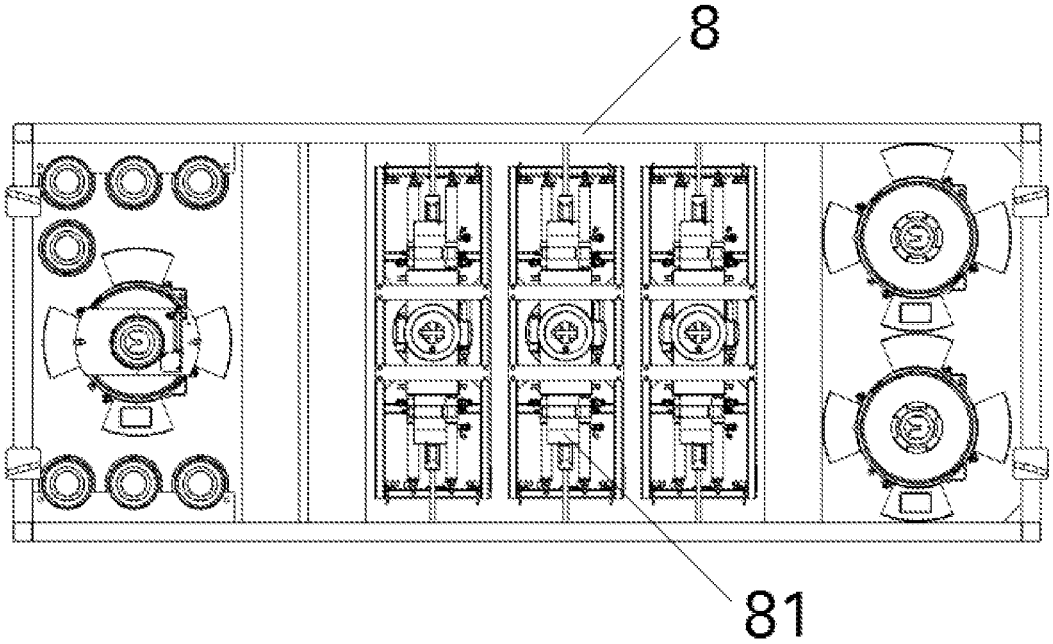
FIG. 11 is an enlarged view of part I in FIG. 2.
Figure 12:
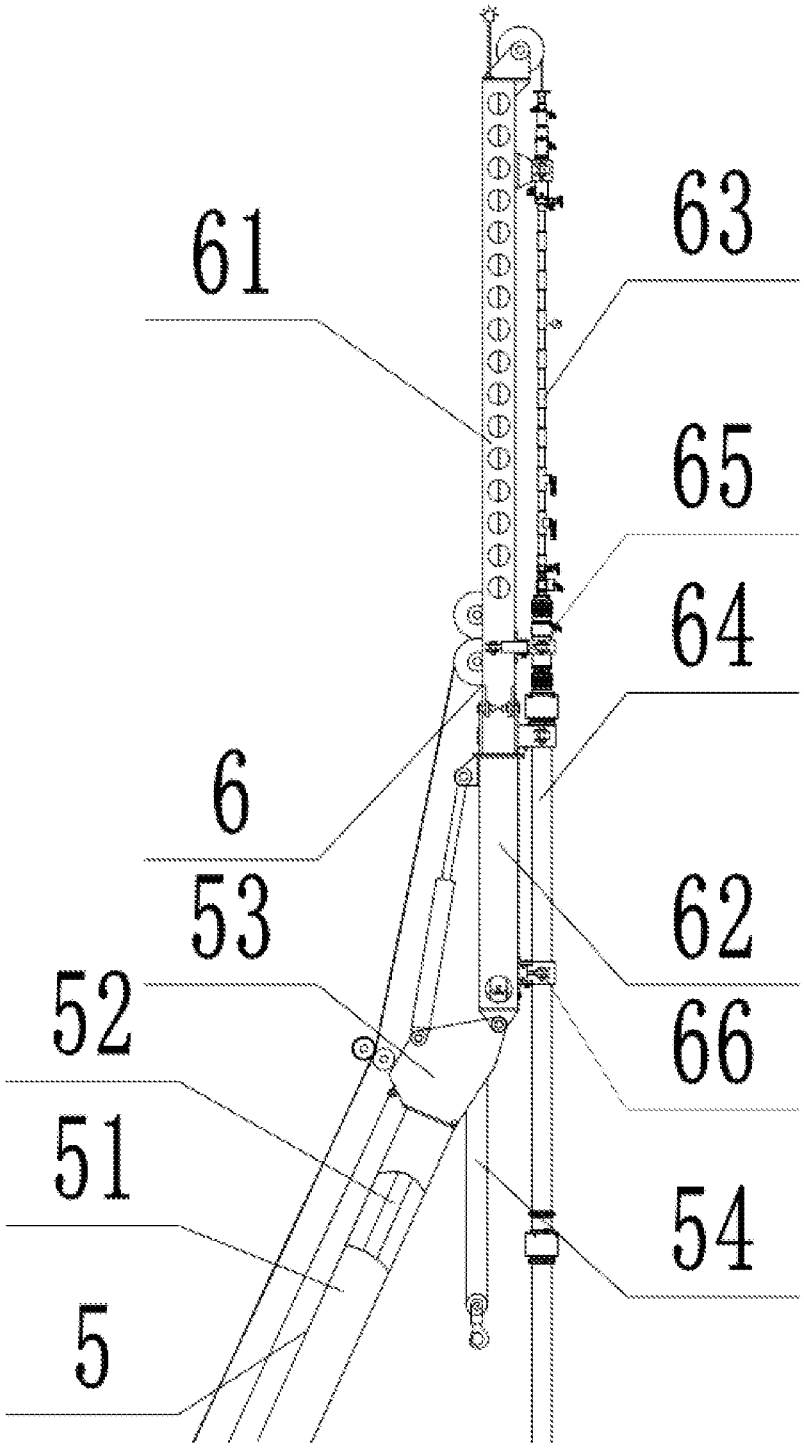
FIG. 12 is an enlarged view of part II in FIG. 10.

As shown in FIG. 10, after the lubricator string assembly is installed, the mechanical arm assembly 6 is adjusted through the telescopic arm assembly 5 to align with the wellhead, such that the lubricator string assembly carried by the mechanical arm assembly 6 is vertically aligned with the wellhead, and information of a position where the wellhead is located is recorded.

The lubricator string assembly is installed through the telescopic arm assembly 5, and rapid pressure test and locking operation are completed.

(3) Installation and Replacement of Tool String

The tool string is run into the well through the logging winch assembly 3.

After the operation is completed, the tool string is vertically pulled out from the inside of the lubricator in the lubricator string assembly through the cooperation of the turntable assembly 2 and the telescopic arm assembly 5, and is placed on a tool holder.

When replacing a perforating gun string, the tool string is pulled into the lubricator in a vertical state through the logging winch assembly 3, and a bridge plug, after being installed on the ground, is pulled into the lubricator string in the lubricator string assembly.

(4) Dismantle of Lubricator String Assembly

After the tool string is taken out, a plug-in connector and the lubricator are vertically and sequentially dismantled through the mechanical arm assembly 6, and after a cable head is fixed and recovered, the turntable assembly 2, the telescopic arm assembly 5 and the mechanical arm assembly 6 are restored to an initial state to complete the operation.

It is apparent for those skilled in the art that the above specific examples are only the preferred scheme of the present disclosure, so the improvements and changes that may be made by those skilled in the art to some parts of the present disclosure still embody the principles of the present disclosure and achieve the purposes of the present disclosure, and all belong to the scope of protection of the present disclosure.

What is claimed is:

1. An integrated plugging and perforating operation system, comprising an operation truck (1), a wellhead equipment transport frame (8), a centralized control room (7) and wellhead blowout preventers (81), wherein a mechanical mechanism and a power mechanism (9) are arranged on a chassis of the operation truck (1);

the mechanical mechanism comprises a turntable assembly (2), a telescopic arm assembly (5) is installed on the turntable assembly (2), a mechanical arm assembly (6) configured for logging operation is installed at an operating end of the telescopic arm assembly (5), and a logging winch assembly (3) and a follow-up winch assembly (4) are arranged at a counterweight end of the telescopic arm assembly (5);

the logging winch assembly (3) and the follow-up winch assembly (4) form a counter weight (10) of the telescopic arm assembly (5);

the power mechanism (9) is configured for providing power output for the mechanical mechanism;

the centralized control room (7) is placed in an area away from a wellhead and communicates with the operation truck (1) through a cable, and is configured to control the chassis and each of the turntable assembly (2), the logging winch assembly (3), the follow-up winch assembly (4), the telescopic arm assembly (5) and the mechanical arm assembly (6) in the mechanical mechanism; and the wellhead equipment transport frame (8) is configured for carrying the wellhead blowout preventers (81) to facilitate transportation;

wherein the follow-up winch assembly (4) comprises a plurality of drums (42) which are arranged coaxially and are installed on the turntable assembly (2), and a second hydraulic motor (41) is arranged on the plurality of drums (42), and wherein the mechanical arm assembly (6) comprises an upper manipulator (61), a lower manipulator (62) is hinged to the upper manipulator (61), a first gripper (65) is attached directly to the upper manipulator (61), a second gripper (66) is attached directly to the lower manipulator (62), a sealing device (63) is clamped by the upper manipulator (61) with the first gripper (65), and a lubricator (64) is clamped by the lower manipulator (62) with the second gripper (66).

2. The integrated plugging and perforating operation system according to claim 1, wherein the turntable assembly (2) comprises a slewing support (21) on the chassis of the operation truck (1), a slewing motor (22) configured for driving the slewing support (21) to rotate and a rotating joint (23) are installed on the slewing support (21), and the telescopic arm assembly (5) is installed at a middle of the slewing support (21).

3. The integrated plugging and perforating operation system according to claim 1, wherein the telescopic arm assembly (5) comprises a telescopic arm (51) and a lift hydraulic cylinder (54) installed on the turntable assembly (2), a telescopic oil cylinder (52) is installed on the telescopic arm (51), a connecting bearing (53) is installed at the operating end of the telescopic arm (51), and the mechanical arm assembly (6) is installed on the connecting bearing (53).

4. The integrated plugging and perforating operation system according to claim 3, wherein the chassis of the operation truck (1) is provided with hydraulic legs (11) and a telescopic arm support (12) configured for supporting only the telescopic arm.

5. The integrated plugging and perforating operation system according to claim 1, wherein the logging winch assembly (3) comprises a drum frame (32) installed on the turntable assembly (2), and a winch drum (31), an automatic rope-arranging device (34) and a metering device (35) are installed on the drum frame (32).

6. The integrated plugging and perforating operation system according to claim 5, wherein a built-in planetary reducer (36) and a first hydraulic motor (37) are installed on a rotating shaft of the winch drum (31), and a brake device (33) is installed on a side of the winch drum (31).

7. The integrated plugging and perforating operation system according to claim 1, wherein a console (71) is arranged in the centralized control room, and a wellhead blowout preventer control module (74), a logging winch control module (72), a telescopic arm control module (73), a mechanical arm control module (75) and a perforator control module (76) are arranged on the console (71).

* * * * *